United States Patent [19]

Turner et al.

[11] 4,162,472

[45] Jul. 24, 1979

[54] LINKAGES

[75] Inventors: Roy C. Turner, Cippenham; Philip J. Constable, Denham, both of England

[73] Assignee: Drayton Controls (Engineering) Limited, England

[21] Appl. No.: 813,331

[22] Filed: Jul. 6, 1977

[30] Foreign Application Priority Data

Jul. 7, 1976 [GB] United Kingdom ..... 28327/76

[51] Int. Cl.[2] ..... H01C 10/14

[52] U.S. Cl. ..... 338/116; 338/160

[58] Field of Search ..... 338/116, 118, 160, 162, 338/183, 188, 36, 42, 190

[56] References Cited

U.S. PATENT DOCUMENTS

| | | | |
|---|---|---|---|
| 813,262 | 2/1906 | Warden et al. | 338/116 |
| 2,515,981 | 7/1950 | Bourns | 338/183 |
| 2,544,328 | 3/1951 | Keroes | 338/190 X |
| 2,884,504 | 4/1959 | Morton | 338/116 |

*Primary Examiner*—C. L. Albritton

*Attorney, Agent, or Firm*—Kane, Dalsimer, Kane, Sullivan and Kurucz

[57] ABSTRACT

An electromechanical transducer comprises first and second links pivotally connected to a base, an electrical resistance element in the form of a track mounted on the base and a wiper arm mounted at one end of the second link and slidingly engaging the track. The first link and the second link are so coupled that pivoting one link is operative to pivot the other link and the angle through which the second link pivots is substantially greater than the angle through which the first link pivots. By suitable selection of the shape and/or the resistance profile of the track, the angular movement of the first link may be arranged to be a particular linear or non-linear function of the resistance tapped by the wiper arm. A control unit incorporating the transducer is also described.

22 Claims, 7 Drawing Figures

LINKAGES

The present invention relates to linkages and in particular to a compact electromechanical transducer incorporating a linkage.

In co-pending British patent application No. 28322/76 entitled "British Circuits" there is described a bridge circuit for use in a control unit operative to produce a mechanical output representative of an electrical input signal applied thereto. An electrical input signal is compared by the bridge circuit with a feedback signal from a potentiometer wiper arm and the output from the comparison circuit representing the voltage difference between the feedback signal and the input signal is passed to an amplifier whose output is connected to a motor which drives the potentiometer wiper arm accordingly. The position of the potentiometer wiper arm represents the first mechanical output of the control unit. However in order that the potentiometer operates satisfactorily it is necessary for the total travel of the wiper arm to be quite large (of the order of 50 mm) for satisfactory resolutions. For many applications a mechanical output involving a travel of 50 mm is much too great; in one particular use of the control unit a travel of 12.5 mm is required. Thus the mechanical output of amplitude 50 mm is required to be reduced by a factor of four. It is also important for most purposes that the reduction in amplitude is constant throughout the range of travel of the wiper arm to avoid non-linearity in the control unit. Such a reduction could be achieved by using a single wiper arm of, say, 250 mm in length and pivoting the arm 200 mm away from the potentiometer track; the end of the wiper arm could then be used to provide the mechanical output of amplitude 12.5 mm. However such an arrangement would occupy a very large amount of space.

There are a number of methods by which this reduction in amplitude of the mechanical output could be achieved in a fairly small space but these methods involve fairly complex and therefore expensive techniques.

It is an object of the invention to provide a compact transducer which overcomes, at least in part, the difficulties described above.

The present invention provides an electromechanical transducer comprising:

a base, a first link pivotally connected at one end to the base, a second link pivotally connected to the base, an electrical resistance element in the form of a track mounted on the base, and a wiper arm mounted at one end of the second link and slidingly engaging the track, the first link and the second link being so coupled that pivoting of one link is operative to pivot the other link and the angle through which the second link pivots is substantially greater than the angle through which the first link pivots.

It is advantageous that, when the first and second links are in respective central positions along their paths of pivotal movement, the coupling of the first link to the second link, the connection of the second link to the base and the connection of the first link to the base lie along a straight line. This arrangement provides a compact linkage.

The other end of the first link may be coupled to the other end of the second link such as to allow sliding movement of the first link along the other end of the second link, and the second link may be pivotally connected to the base between its ends.

The ratio of the movement of the point of contact of the wiper arm along the track to the angular movement of the first link will be referred to as the magnification of the linkage.

The track may be so shaped that the movement of the contact point of the wiper arm along the track is a particular linear function of the angular movement of the first link; in this case the magnification of the linkage is constant. Alternatively the track may be so shaped that the movement of the contact point of the wiper arm along the track is a particular non-linear function of the angular movement of the first link; in this case the magnification of the linkage varies in a preselected manner.

It is advantageous that the track lies on the circle of radius R whose centre lies in a plane passing through the point of contact of the wiper arm on the track and the axis of pivoting of the second link on the base when the coupling of the first link to the second link, the connection of the second link to the base, and the connection of the first link to the base lie along a straight line, the radius R of the circle being given by the equation $$R = L1 \cdot D1 / D2$$

Where L1 is the distance between the connection of the first link to the base and the coupling of the first link to the second link,

D1 is the distance between the point of contact of the wiper arm on the track and the connection of the second link to the base in any given position of the links, and

D2 is the distance between the coupling of the first link to the second link and the connection of the second link to the base in the same given position of the links. This arrangement gives constant magnification.

The second link may be coupled to the first link by the engagement of a projecting part of one link with a slot in the other link. The slot may be provided in the second link and the projecting part may be provided on the first link.

Preferably, the distance between the pivotal connection of the first link to the base and the pivotal connection of the second link to the base is substantially greater than the distance between the pivotal connection of the second link to the base and the coupling of the second link to the first link. This arrangement gives a relatively large magnification for a compact linkage.

It is also preferable that the distance between the point of contact of the wiper arm on the track and the pivotal connection of the second link to the base is substantially greater than the distance between the pivotal connection of the second link to the base and the coupling of the second link to the first link. This arrangement gives a relatively large magnification.

The pivotal connection of the second link to the base may be made through a hole in the first link. The hole may be so dimensioned that the pivotal movement of the second link relative to the first link is limited.

The length of the first link may be comparable to the length of the second link. This relative sizing of the links produces a compact arrangement.

Means may be provided in driving engagement with the linkage to pivot the first and second links. Said means may comprise a motor. A third link may be provided in driving engagement with the motor, pivotally connected to the second link and extending transversely to the second link.

The present invention also provides a control unit operative to produce a mechanical output representative of an electrical input signal applied thereto, the control unit including:

an electromechanical transducer constructed in accordance with the invention and connected in a feedback loop of an electrical circuit of the unit, and a comparison circuit for comparing the electrical input signal to the control unit and an electrical output signal from the transducer, the output of the comparison circuit being connected to control the position of the wiper arm.

The shape of the track may be selected to compensate for non-linearity in the characteristic of the input to the control unit; for example a non-linear characteristic of the track may be employed in compensating for a non-linear relation in, for example, the temperature-voltage characteristic of a thermocouple connected to the input of the control unit.

Embodiments of the invention will now be described by way of example only with reference to the accompanying drawings, of which:

Figure 1:
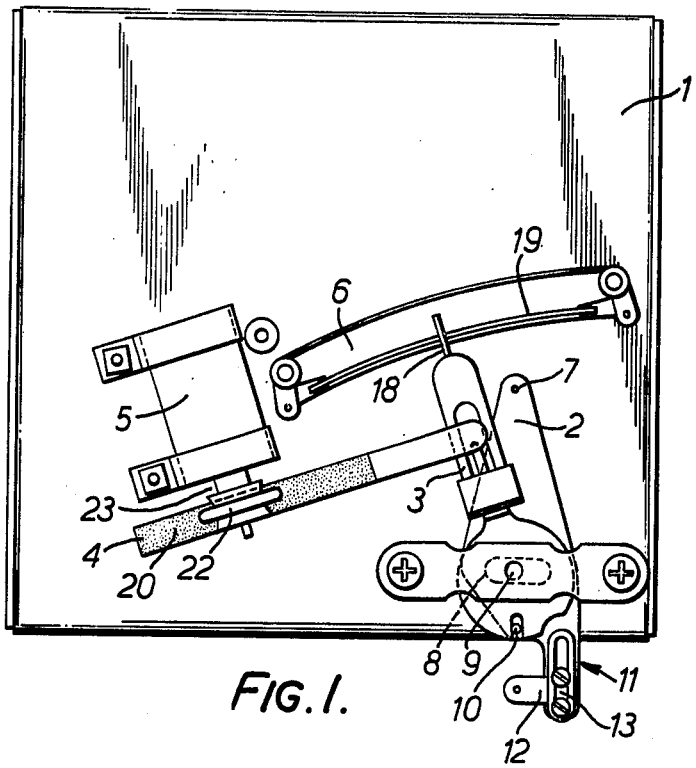
FIG. 1 is a plan view of an embodiment of the invention.
Figure 2:
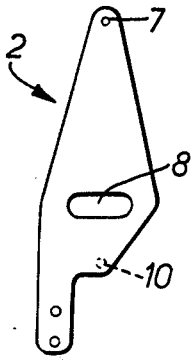
FIGS. 2 and 3 are underneath plan and plan views respectively of parts of the embodiment of FIG. 1.
Figure 3:
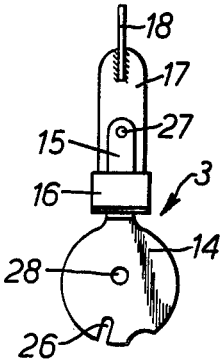
Figure 4:
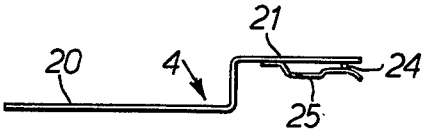
FIG. 4 is a side view of another part of the embodiment of FIG. 1.

Referring to FIGS. 1 to 4, a linkage generally comprises a base 1, a first link 2 shown separately in FIG. 2, a second link 3 shown separately in FIG. 3 and a third link 4 shown in elevation in FIG. 4. A motor 5 and a strip of plastics material 6 mounting a potentiometer track are also mounted on the base 1.

The first link 2 has a small ball shaped pivot 7 secured to the underside of the link 2 at one end thereof; the pivot 7 locates in a hole in the base of diameter corresponding to that of the ball and in this way the first link is pivotally mounted on the base. A generally rectangular hole 8 is formed in the link 2 towards the other end of the link. A ball shaped pivot 9 extends from the base through the hole 8 so that the pivotal movement of the link 2 is limited by the abutment of either end wall of the hole 8 with the pivot 9. A further ball-shaped pivot 10 is provided on the link 2 extending upwardly from the link. The pivot 10 is positioned further from the pivot 7 than from the hole 8 and with the pivots 7 and 10 and the middle of the hole 8 lying along a straight line.

The link 2 has a projecting arm 11 on which an operating member 12 is mounted. The member 12 has a slot 13 through which two screws pass to locate the member on the link 2 and allow sliding adjustment of the position of the member 12.

The second link 3 is mounted on top of the first link 2 and is in sliding contact with the link 2. The link 3 has a generally circular part 14 integral with a raised arm 15. An insulating collar 16 is mounted on the raised arm 15 and a terminal 17 extends from the collar 16. The part 14 of the link 3 is formed with a hole 28 which locates over the pivot 9 to mount the link 3 pivotally upon the base 1. The periphery of the part 14 is also provided with a slot 26 which houses the pivot 10 upstanding from the first link. The periphery of part 14 is also indented in the region of the member 12 so that movement of the link 3 is not obstructed by the member 12.

The raised arm 15 of the link 3 is formed with a hole 27 through the free end of the arm (FIG. 3).

The terminal 17 has a wiper arm in the form of a rod 18 soldered at one end to the terminal and in sliding contact with the potentiometer track 19. The terminal 17 is made of resilient metal and biasses the wiper arm down onto the track 19.

The third link 4 has a lower base portion 20 and a raised portion 21. The base portion 20 is provided with a low friction coating on its underside and a high friction coating on its upper side which engages a rubber drive wheel 22 of the motor 5. A low friction pad 23 is also provided on the base 1 beneath the drive wheel 22. The raised portion 21 of the link 4 has a ball shaped pivot 24 on the underside and at the free end of the portion 21 (FIG. 4). The free end of portion 21 is also provided with a spring clip 25 which as shown in FIG. 4 is biassed into contact with the pivot 24. The link 4 is pivotally connected to the link 3 through the location of pivot 24 in the hole 27; the arm 15 of link 3 is sandwiched between the spring clip 25 (below) and portion 21 (above) of link 4.

The strip of plastics material 6 if fixed securely to the base and a track 19 is located on the upper surface of the strip. A large number of alternative types of wire can be used for the track but a nickel-chrome wire is particularly suitable. The wire is wound on an enamelled copper wire.

Figure 5:
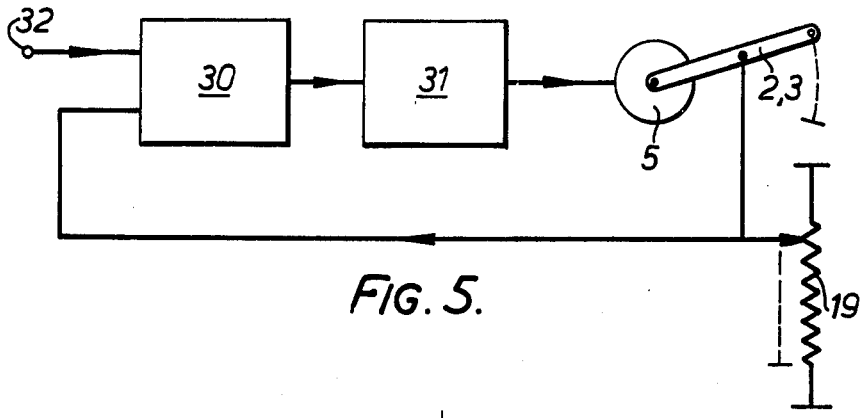
FIG. 5 is a schematic diagram of a control unit incorporating the embodiment shown in FIGS. 1 to 4.

FIG. 5 shows schematically a system in which the transducer of FIGS. 1 to 4 can be operated. The system comprises a comparison circuit 30 which compares an electrical input signal at the input 32 to the system with a feedback signal from the potentiometer wiper arm 18. The output from the comparison circuit representing the voltage difference between the feedback signal and the input signal is passed to an amplifier 31 whose output is connected to the motor 5. One form of comparison circuit which may be used is described in co-pending British patent application No. 28322/76 entitled "Bridge Circuits".

When the link 4 is driven by the motor 5, for example to the right as seen in FIG. 1, it acts on link 3 to rotate this link clockwise about the pivot 9; the action of rotating the link 3 clockwise moves the slot 26 of the link to the left and thus moves the pivot 10 of the link 2 clockwise to the left; since the link 2 is pivoted to the base at its other end, the link is caused to rotate clockwise so that the operating member 12 moves to the left along an arcuate path. The angle through which link 2 rotates is substantially less than the angle through which link 3 rotates since the link 2 is pivoted to the base at a position much further from the slot 26 and pivot 10 connection of the links 2 and 3, than the pivotal connection of the link 3 to the base. The ratio of angular rotations of the first and second links for small rotations of the links will vary as the links are rotated.

As the link 3 is rotated by the motor wiper arm 18 moves along the track 19 of the potentiometer so that a voltage representative of the position of the arm on the track is fed back to the comparison circuit; the voltage is compared with the input voltage and the output of this comparison passed to the motor. In this way the potentiometer is set to a voltage proportional to the input voltage.

As described above the relationship of pivotal movement of the link 2 to pivotal movement of the link 3 is not linear. Thus if a linear relationship is required between the pivotal movement of the operating member 12 and the input voltage a non-linear relationship must be provided between the pivotal movement of the link 3 and the distance moved by the wiper arm 18 along the track 19. This can be achieved by shaping of the potentiometer track 19 and/or resistance profiling of the track so that the relationship between the pivotal movement of the link 2 and the distance moved by the wiper arm 18 along the track is linear. When the pivot 9 is centrally disposed in the hole 8, the distance from pivot 9 to pivot 10 is a minimum and thus the ratio of pivotal movement of the link 2 to pivotal movement of the wiper arm 18 is a minimum. As the pivot 10 moves towards one end of the hole 8 the pivotal movement of wiper arm 18 for an increment of pivotal movement of the link 2 decreases; thus to obtain overall linearity, the track 19 must be shaped so that as the wiper arm is moved outwardly from the centre of the track the pivotal movement of wiper arm 18 required to cause an increment of movement of the wiper arm along the track decreases correspondingly. This can be achieved by shaping the track so that the distance of the track 19 from the pivot 9 is smallest at the mid-point of the track which the wiper-arm contacts in its central position, and increases progressively as one moves away from the mid-point of the track.

One precise shape of the track 19 which exactly compensates for the non-linearity in the linkage is a circular track of a particular radius. The manner in which such a track results in linear magnification, and the manner in which the required radius for the track can be calculated is explained with reference to FIG. 6.

Figure 6:
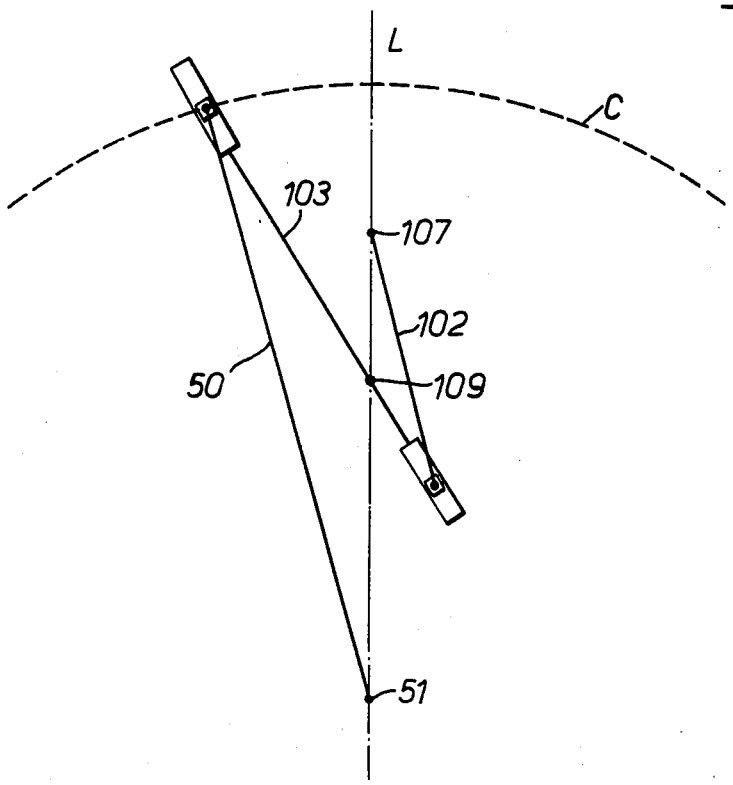
FIG. 6 is a schematic illustration of a three bar mechanism.

FIG. 6 is a schematic illustration of the linkage shown in FIG. 1 with the parts in FIG. 6 referenced with the same reference numeral as used for the corresponding part in FIGS. 1 to 4 but with the prefix "10" added. In FIG. 6 the link 103 representing the link 3 is shown as being straight whereas in FIG. 1 it is bent (that is the rod 18, pivot 9 and pivot 10 do not lie on the same straight line). However this bending of the link does not affect the shape of the track required but only the position of the centre of the circle on which its lies. Also on additional link 50 is shown in FIG. 6. This link is hypothetical and is shown merely to assist explanation of the operation of the linkage. It should be noted that this hypothetical link does not in any way affect the operation of the links 102 and 103.

In FIG. 6 a line L is drawn through the static pivots 107 and 109. The hypothetical link 50 is connected at one end to the link 103 so as to allow sliding movement of the link 50 along the link 103, and at the other end is pivoted on a pivot 5, located on the line L. The position of the pivot 51 on the line L is such that in the position shown in the drawing, the linkage on the left of the line L is merely an enlarged version of the linkage to the right of the line L when rotated through 180°. The inclination of the link 50 to the line L is the same as the inclination of the link 102 to that line. Furthermore it will be seen that this is true for all positions of the linkage and it will also be appreciated that the link 50 in no way affects the operation of the links 102 and 103.

Thus the end of the link 50 connected to the link 103 moves along a circular path C and the distance travelled along this path is directly proportional to the angle through which the link 50 pivots (or the angle through which the link 102 pivots). Thus, with or without link 50, the ratio of the angle through which the link 102 pivots to the distance moved along the path C of the point of intersection of the link 103 and the path C is constant for all possible angles of inclination of the link 102 to the line L.

It can therefore be seen that the radius R of the path C (which equals the length of the link 50) is given by the expression:

$$R/L1 = D1/D2$$

where

L1 is the length of the link 102,

D1 is the distance between the connection of the link 50 to the bar 103 and the pivot 109 at any given position of the mechanism, and D2 is the distance between the connection of the link 102 to the link 103 and the pivot 109 for the same given position.

The required radius R of the track 19 can therefore be calculated for the linkage of FIG. 1. The centre of the circle on which the track 19 is disposed lies on the line passing through the point of contact of the wiper arm 18 on the track 19 and the pivot 9, when the linkage is in its central position with the pivots 7, 9 and 10 lying on a common straight line. It will be seen from the discussion above that the magnification of the linkage is determined by the ratio of the distances D1 and D2.

Figure 7:
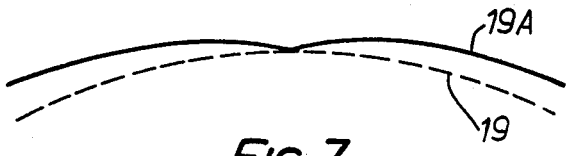
FIG. 7 is an illustration of a modification which may be made to the embodiment of FIGS. 1 to 4.

The circular track described above is one example of a track which provides linear magnification. However it should be understood that there are other shapes which also provide linear magnification. FIG. 7 shows the shape (not to scale) of another track 19A which would provide linear magnification, the circular track 19 being shown in dotted outline to provide a comparison. It can be seen that the track 19A has a discontinuity at the centre; this is a disadvantage of using a non-circular track.

In the system of FIG. 5 there are many sources of electrical input which may be used to produce the mechanical output. For example the input may be supplied by a thermocouple and the output connected to a pen recorder. In this case since the temperature-voltage characteristic of a thermocouple is non-linear, it is desirable to shape and/or resistance-profile the potentiometer track 19 so that there is non-linearity in the relationship of pivotal movement of the link 2 to movement of the wiper arm 18 along the track. This non-linearity can be selected to offset the non-linearity of the thermocouple characteristic and thus provide a linear relationship between the temperature measured by the thermocouple and the pivotal movement of the link 2.

The linkage described provides a simple, cheap and very compact arrangement which has a high degree of resolution, about 0.1% of the overall movement of the operating member 12.

The control system described with reference to FIG. 5 can replace a known control system incorporating a Bourdon tube. In the known system a Bourdon tube is connected to one end of a capillary tube, the other end of which is connected to a suitable sensor which responds to the parameter sensed by a change in volume; for example a bulb filled with mercury is a suitable temperature sensor. In this example, as the temperature of the environment rises the Bourdon tube uncoils and the mechanical movement of the uncoiling is used to operate a mechanical device which may for example, be a pneumatic control unit for operating a control valve or alternatively a pen recorder. The control system of FIG. 5 is used in conjunction with a sensor which responds to the parameter sensed by a change in an electrical property; for example, as previously described, a thermocouple is a suitable temperature sensor. The mechanical output provided by the operating member 12 on link 2 is the same as the mechanical output of a Bourdon tube. The use of a sensor having an electrical output has several advantages:

the distance between the sensor and the control unit can be greater; in the case of a Bourdon tube the distance is restricted by the length of capillary tube which can be used;

there is no fluid in the system which can leak and contaminate environments; such leakage of fluid from the Bourdon tube system would also produce a false coiling of the Bourdon tube;

the control system can be used for many more applications since many more types of sensors can be arranged to give electrical output than can be arranged to give a volume change output.

In the embodiment described above one potentiometer track is provided. However, it is possible to provide a plurality of such tracks each having a respective wiper arm; conveniently the tracks can be positioned one above another and the wiper arms can be similarly positioned, each wiper arm being secured to a common insulating block mounted on the link 3. Other modifications and variations can be made.

What we claim is:

1. An electromechanical transducer comprising:

a base, a first link pivotally connected at one end to the base, a second link pivotally and directly connected to the base, an electrical resistance element in the form of a track mounted on the base, and a wiper arm mounted at one end of the second link and slidingly engaging the track, the first link and the second link being so coupled that pivoting of one link is operative to pivot the other link and the angle through which the second link pivots is substantially greater than the angle through which the first link pivots.

2. An electromechanical transducer as claimed in claim 1 in which the other end of the first link is coupled to the other end of the second link such as to allow sliding movement of the first link along the other end of the second link, and in which the second link is pivotally connected to the base between its ends.

3. An electromechanical transducer as claimed in claim 2 in which the track is so shaped that the movement of the contact point of the wiper arm along the track is a particular linear function of the angular movement of the first link.

4. An electromechanical transducer as claimed in claim 1 in which the track is so shaped that the angular movement of the contact point of the wiper arm along the track is a particular non-linear function of the angular movement of the first link.

5. A electromechanical transducer as claimed in claim 3 in which the track lies on a circle of radius R whose centre lies in a plane passing through the point of contact of the wiper arm on the track and the axis of pivoting of the second link on the base when the coupling of the first link to the second link, the connection of the second link to the base, and the connection of the first link to the base lie along a straight line, the radius R of the circle being given by the equation $$R = L1 \cdot D1 / D2$$

where L1 is the distance between the connection of the first link to the base and the coupling of the first link to the second link,

D1 is the distance between the point of contact of the wiper arm on the track and the connection of the second link to the base in any given position of the links, and

D2 is the distance between the coupling of the first link to the second link and the connection of the second link to the base in the same given position of the links.

6. An electromechanical transducer as claimed in claim 1 in which the second link is coupled to the first link by the engagement of a projecting part of one link with a slot in the other link.

7. An electromechanical transducer as claimed in claim 6 in which the slot is provided in the second link and the projecting part is provided on the first link.

8. An electromechanical transducer as claimed in claim 1 in which the distance between the pivotal connection of the first link to the base and the pivotal connection of the second link to the base is substantially greater than the distance between the pivotal connection of the second link to the base and the coupling of the second link to the first link.

9. An electromechanical transducer as claimed in claim 8 in which the distance between the point of contact of the wiper arm on the track and the pivotal connection of the second link to the base is substantially greater than the distance between the pivotal connection of the second link to the base and the coupling of the second link to the first link.

10. An electromechanical transducer as claimed in claim 1 in which the pivotal connection of the second link to the base is made through a hole in the first link.

11. An electromechanical transducer as claimed in claim 10 in which the hole in the first link is so dimensioned that the pivotal movement of the second link relative to the first link is limited.

12. An electromechanical transducer as claimed in claim 1 in which the length of the first link is comparable to the length of the second link.

13. An electromechanical transducer as claimed in claim 1 in which drive means are provided in driving engagement with the linkage to pivot the first and second links.

14. An electromechanical transducer as claimed in claim 13 in which said means comprises a motor.

15. An electromechanical transducer as claimed in claim 14 in which a third link is provided in driving engagement with the motor, pivotally connected to the second link and extending transversely to the second link.

16. An electromechanical transducer as claimed in claim 1 in which the other end of the first link provides a mechanical output of the transducer.

17. An electromechanical tranducer comprising:

a base, a first link pivotally connected at one end to the base, a second link pivotally and directly connected to the base, an electrical resistance element in the form of a track mounted on the base, and a wiper arm mounted at one end of the second link and slidingly engaging the track, the first link and the second link being so arranged that pivoting of one link is operative to pivot the other link and the angle through which the second link pivots is substantially greater than the angle through which the first link pivots, and also being so arranged that when the first and second links are in respective central positions along their paths of pivotal movement, the coupling of the first link to the second link, the connection of the second link to the base and the connection of the first link to the base lie along a straight line.

18. An electromechanical transducer as claimed in claim 17 in which the other end of the first link is coupled to the other end of the second link such as to allow sliding movement of the first link along the other end of the second link, and in which the second link is pivotally connected to the base between its ends.

19. An electromechanical transducer as claimed in claim 18 in which the track is so shaped that the movement of the contact point of the wiper arm along the track is a particular linear function of the angular movement of the first link.

20. An electromechanical transducer as claimed in claim 19 in which the track lies on a circle of radius R whose centre lies in a plane passing through the point of contact of the wiper arm on the track and the axis of pivoting of the second link on the base when the coupling of the first link to the second link, the connection of the second link to the base and the connection of the first link to the base lie along a straight line, the radius R of the circle being given by the equation $$R = L1 \cdot D1 / D2$$

where L1 is the distance between the connection of the first link to the base and the coupling of the first link to the second link,

D1 is the distance between the point of contact of the wiper arm on the track and the connection of the second link to the base in any given position of the links, and

D2 is the distance between the coupling of the first link to the second link and the connection of the second link to the base in the same given position of the links.

21. An electromechanical transducer as claimed in claim 17 in which the other end of the first link provides the mechanical output of the transducer.

22. A control unit operative to produce a mechanical output representative of an electrical input signal applied thereto, the control unit including an electromechanical transducer connected in a feedback loop of an electrical circuit of the unit and a comparison circuit for comparing the electrical input signal to the control unit with an electrical output signal from the transducer, wherein the transducer comprises:

a base, a first link pivotally connected at one end to the base, a second link pivotally and directly connected to the base, an electrical resistance element in the form of a track mounted on the base, and a wiper arm mounted at one end of the second link and slidingly engaging the track, the output of the comparison circuit being connected to control the position of the wiper arm, the first link and the second link being so coupled that pivoting of one link is operative to pivot the other link and the angle through which the second link pivots is substantially greater than the angle through which the first link pivots.

* * * * *

UNITED STATES PATENT OFFICE

CERTIFICATE OF CORRECTION

PATENT NO. : 4,162,472

DATED : July 24, 1979

INVENTOR(S) : ROY C. TURNER, ET AL

It is certified that error appears in the above-identified patent and that said Letters Patent are hereby corrected as shown below:

Column 1, line 8, "British" should be --Bridge--;

Column 5, line 49, "on" should be —an--;

Signed and Sealed this

*Twenty-ninth* Day of *January 1980*

[SEAL]

*Attest:*

SIDNEY A. DIAMOND

*Attesting Officer*

*Commissioner of Patents and Trademarks*